US005573440A

United States Patent [19]

Schneider et al.

[11] Patent Number: 5,573,440

[45] Date of Patent: Nov. 12, 1996

[54] AUDIO PLAYBACK SYSTEM FOR STEERING WHEEL OF CHILD'S VEHICLE

[75] Inventors: Frank Schneider, Neustadt/Coburg; Ulrich Ewringmann, Taufkirchen, both of Germany

[73] Assignee: Franz Schneider GmbH & Co. KG, Germany

[21] Appl. No.: 380,293

[22] Filed: Jan. 30, 1995

[30] Foreign Application Priority Data

Jan. 31, 1994 [DE] Germany ..... 9401559 U

[51] Int. Cl.[6] ..... A63H 5/00

[52] U.S. Cl. ..... 446/404; 446/7; 74/552

[58] Field of Search ..... 446/397, 409, 446/404, 7, 455, 454, 81; 74/552; 434/45, 62; 280/288.4, 777; 273/148 B

[56] References Cited

U.S. PATENT DOCUMENTS

| | | | |
|---|---|---|---|
| 3,120,716 | 2/1964 | Orenstein | 446/7 |
| 3,204,367 | 9/1965 | Stubbmann | 446/7 X |
| 4,932,913 | 6/1990 | Raviv et al. | 446/7 |

*Primary Examiner*—Mickey Yu
*Attorney, Agent, or Firm*—Juettner Pyle Lloyd & Piontek

[57] ABSTRACT

An audio playback system for the steering wheel of a child's vehicle is provided. A central housing is provided in the steering wheel, with the housing having an open top. An audio playback module is removably contained in the housing. The playback module includes an open battery compartment. A water fight cover is provided over the open top of the housing.

4 Claims, 3 Drawing Sheets

AUDIO PLAYBACK SYSTEM FOR STEERING WHEEL OF CHILD'S VEHICLE

BACKGROUND OF THE INVENTION

The present invention relates generally to a vehicle for children, such as a pedal car for children, a motor-driven vehicle for children, or also a vehicle without drive that is moved by a child by pushing off from the ground. To be more specific, the present invention relates to a steering wheel designed in a special manner for use in a vehicle for children.

There have been known children's vehicles whose steering wheels are provided with a horn like those of real automotive vehicles, so that a child sitting in the vehicle or driving in such a vehicle is capable of producing warning signals, thereby imitating, for instance, traffic situations.

SUMMARY OF THE INVENTION

It is the object of the present invention to provide a vehicle for children having an increased enjoyment value.

The vehicle for children according to the invention comprises an audio playback system integrated into the vehicle. The audio playback means may be installed at any suitable place in the vehicle, for instance at a suitable place in the vehicle body. Preferably, however, the audio playback is arranged on the steering wheel or integrated thereinto, or on a steering rod if such a rod is present in the vehicle instead of a steering wheel.

After a push button or switch has been pressed, the audio playback means preferably emits an electronic, sound, such as engine noise, thereby creating, for instance, the impression that the vehicle is being driven by an engine and is surrounded by lively traffic. Playing with such a vehicle becomes much more attractive due to the noises triggered by the child.

In a specifically advantageous embodiment of the invention, the audio playback means is arranged in a housing which is positioned approximately centrally in the steering wheel and secured to the spokes of the steering wheel. The housing is expediently provided with a removable cover for replacing, for instance, a battery accommodated therein.

In a further embodiment of the invention, the housing has the shape of a hexagon in plan view with alternately shorter and longer sides, with three wheel spokes being attached to the respectively shorter sides. The shorter sides and the longer sides, respectively, of the housing are preferably of about the same length, and the comers of the hexagon are slightly rounded to exclude any risk of injury.

The audio playback means may be of any type and may comprise a circuit board with electronic signals recorded thereon, a power source in the form of batteries or of an accumulator and loudspeaker that are electrically interconnected and preferably fixedly installed in the housing. However, it is also within the scope of the invention to provide a different audio playback means, for instance cassette playback device which may fixedly be installed in the housing. Although such a playback device is more expansive than the above-mentioned electronic playback means, it has the advantage that a child can put in and play back different cassettes. It goes without saying that, apart from the already mentioned traffic sounds, fairy tales, music or other sound may be recorded and played. A miniature cassette playback device can be integrated into the steering wheel of the invention without any problem.

The press button for the playback device is expediently positioned on the cover of the housing, with or without the addition of a horn button.

BRIEF DESCRIPTION OF THE DRAWINGS

The invention will now be illustrated in more detail with reference to a preferred embodiment taken in conjunction with the attached drawing, in which.

DESCRIPTION OF THE PREFERRED EMBODIMENTS

Figure 1:
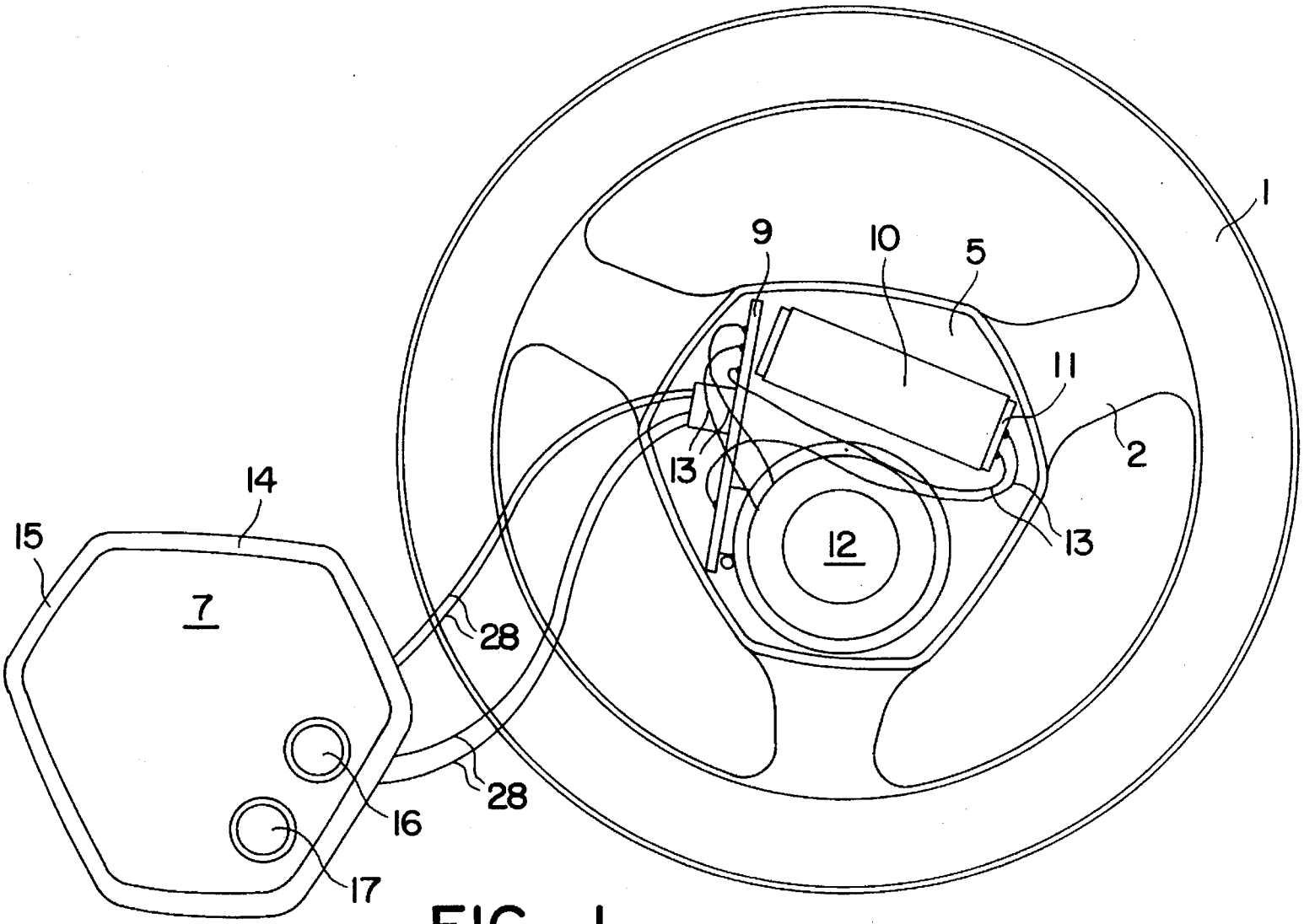
FIG. 1 is a top view on a steering wheel of the invention with the cover removed.
Figure 2:
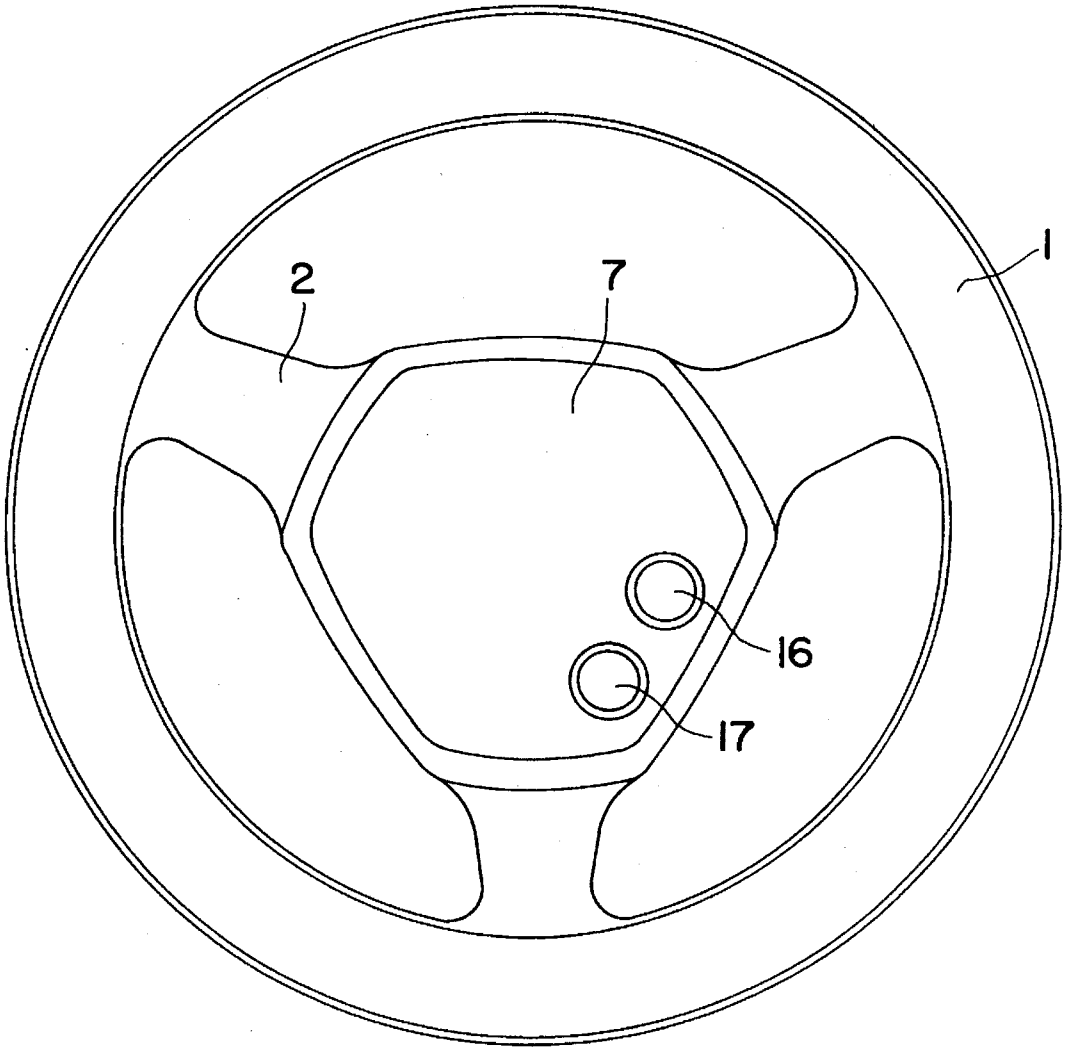
FIG. 2 is a top view on the steering wheel according to FIG. 1 with the cover in place.

The figures show a steering wheel 1 of a vehicle for children, the steering wheel being connected through three spokes 2 to a sleave-like section 3 which extends around the steering rod 4 of the vehicle and is connected to the rod for rotation therewith.

A housing 5 is secured centrally within the steering wheel 1 to the radial spokes 2. The housing 5 comprises a downwardly open cylindrical portion 6 and a chamber 8 positioned thereabove for housing the playback device, and an upper removable cover 7. Cover 7 is positioned at a lower level relative to steering wheel 1 and preferably closes the chamber 8 in a watertight manner.

The electronic audio playback means shown in FIG. 1 includes a circuit board 9 with an audio signal device, batteries 10 with an associated mounting 11, and a loudspeaker 12, the components being interconnected by electrical lines 8.

Cover 7 which, like the associated housing 5, has the shape of a hexagon with alternately longer sides 15 and shorter sides 15 when viewed from the top. The cover comprises a press button 16 for activating and deactivating the playback means, and another push button 17 which, when pressed, will activate a horn as long as it remains depressed. Both push buttons 16 and 17 are connected by means of lines 28 to circuit board 9.

Figures 3, 4:
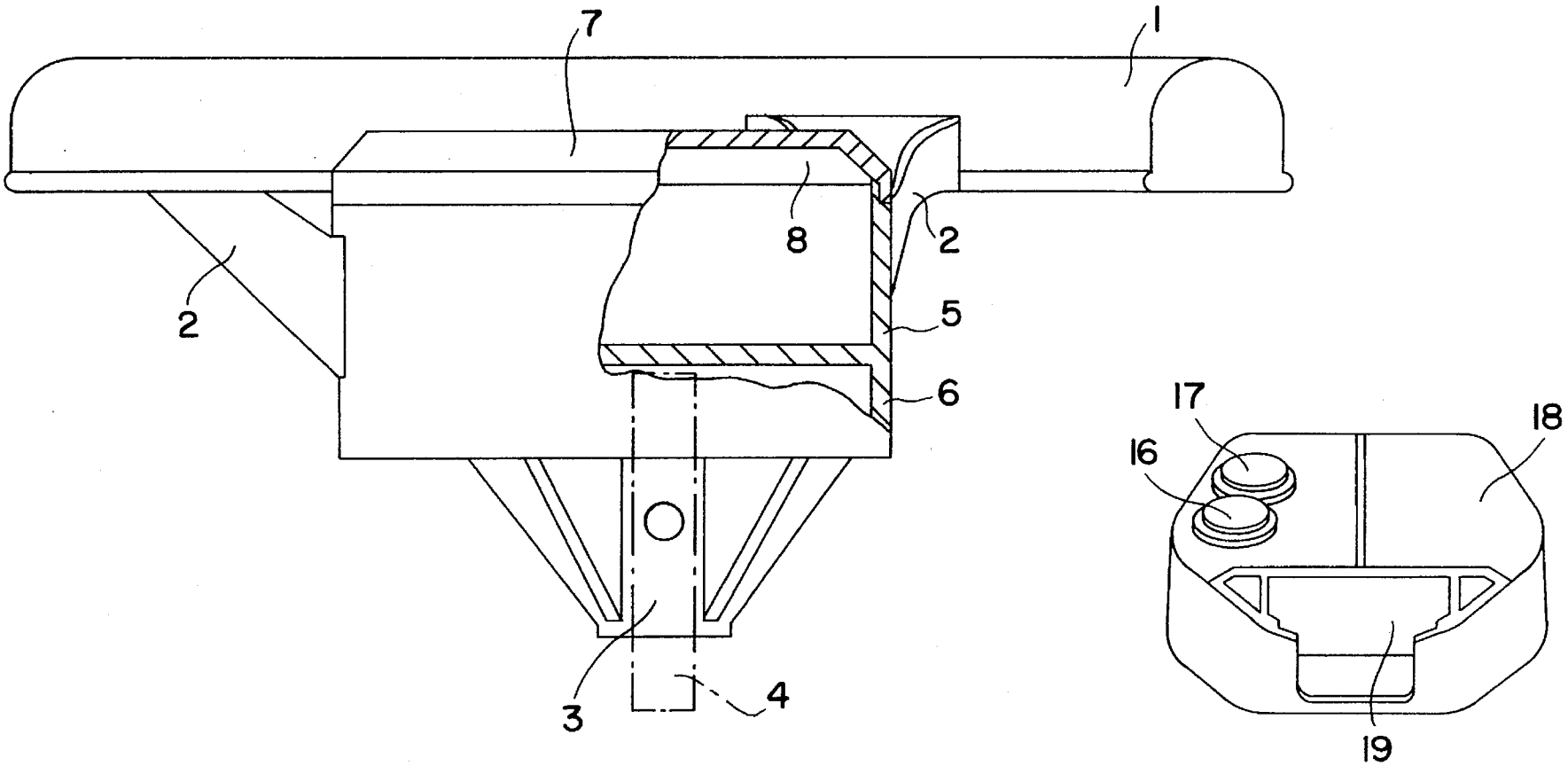
FIG. 3 is a partial sectional side view of the steering wheel according to FIG. 2.
FIG. 4 is a perspective view of another embodiment of a housing.

In an alternative embodiment shown in FIG. 4, all components of the audio playback means are accommodated in a housing 18 which has essentially the same shape as the accommodating chamber 8 into which the housing is inserted with very small clearance. In plan view, the housing 18 has the above-described hexagonal shape and is closed on all sides, except for holes in the bottom plate for the passage of sound, with a separate lateral accommodating chamber 19 for the batteries comprising openings for replacing the same. The two push buttons 16 and 17 project from the upper side of said housing 18. The push buttons are made of a rubber-like material and extend through the two holes within cover 7 in such a manner that they are seated therein with a slight clamping fit, whereby cover 7 is retained on the housing 18. Cover 7 grips over the edge of accommodating chamber 8, thereby closing the housing with the audio playback means in a watertight manner. The housing 18 with the audio playback means can easily be removed for replacing the batteries by lifting the cover together with the housing retained thereon.

We claim:

1. An audio playback system for the steering wheel of a child's vehicle, said system comprising a central housing in said steering wheel having an open top, a self-contained audio playback module removably contained in said housing, said module comprising an enclosure and sound producing elements in said enclosure and an open battery compartment attached to said enclosure, and cover means removably mounted over the open top of said housing for retaining said playback module in a water tight manner.

2. The audio playback system of claim 1 wherein said cover means comprises an opening, and said module additionally comprises an actuating button extending through said opening in a sealed manner.

3. The audio playback system of claim 1 wherein said enclosure for said module is closed on all sides except for openings for the passage of sound.

4. The audio playback system of claim 1 wherein said steering wheel comprises spokes, and said central housing is attached to said spokes.

* * * * *